US009170510B2

(12) United States Patent
Araki

(10) Patent No.: US 9,170,510 B2
(45) Date of Patent: Oct. 27, 2015

(54) DEVELOPER, METHOD OF MANUFACTURING THE SAME AND TONER CARTRIDGE

(71) Applicants: Kabushiki Kaisha Toshiba, Tokyo (JP); Toshiba Tec Kabushiki Kaisha, Tokyo (JP)

(72) Inventor: Satoshi Araki, Shizuoka-ken (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/145,228

(22) Filed: Dec. 31, 2013

(65) Prior Publication Data

US 2014/0199621 A1 Jul. 17, 2014

(30) Foreign Application Priority Data

Jan. 17, 2013 (JP) ..... 2013-006588

(51) Int. Cl.
*G03G 9/087* (2006.01)
*G03G 9/08* (2006.01)

(52) U.S. Cl.
CPC ..... *G03G 9/08755* (2013.01); *G03G 9/0815* (2013.01); *G03G 9/0821* (2013.01); *G03G 9/0825* (2013.01); *G03G 9/08797* (2013.01)

(58) Field of Classification Search
CPC ..... G03G 9/09392; G03G 9/09328; G03G 9/09321; G03G 9/08755; G03G 9/08797; G03G 9/08795
USPC ..... 430/110.2, 109.4
See application file for complete search history.

(56) References Cited

U.S. PATENT DOCUMENTS

| | | | | |
|---|---|---|---|---|
| 5,428,435 | A * | 6/1995 | Yasuda et al. | 430/123.55 |
| 2007/0037085 | A1* | 2/2007 | Ishii et al. | 430/110.2 |
| 2007/0166635 | A1* | 7/2007 | Yamamoto et al. | 430/108.8 |
| 2011/0097659 | A1* | 4/2011 | Sugiura et al. | 430/108.2 |
| 2011/0104605 | A1* | 5/2011 | Kim et al. | 430/108.4 |
| 2011/0151368 | A1* | 6/2011 | Hong et al. | 430/108.8 |
| 2011/0183252 | A1* | 7/2011 | Pang et al. | 430/109.4 |
| 2012/0100478 | A1* | 4/2012 | Sukeno et al. | 430/109.4 |

FOREIGN PATENT DOCUMENTS

JP 2011-237801 A 11/2011

* cited by examiner

*Primary Examiner* — Hoa V Le
(74) *Attorney, Agent, or Firm* — Patterson & Sheridan, LLP

(57) ABSTRACT

A toner or developer is provided having toner particles which exhibit a higher glass transition temperature on their surface than the interior thereof. In one aspect, the toner particles contain a crystalline polyester resin, an amorphous polyester resin and a coloring material, in which the core of the toner particles exhibit the glass transition temperature g of from 30° C. to 45° C. and the surface of the toner particles exhibits the glass transition temperature of from 50° C. to 70° C.

14 Claims, 2 Drawing Sheets

DEVELOPER, METHOD OF MANUFACTURING THE SAME AND TONER CARTRIDGE

CROSS-REFERENCE TO RELATED APPLICATION

This application is based upon and claims the benefit of priority from Japanese Patent Application No. 2013-006588, filed Jan. 17, 2013, the entire contents of which are incorporated herein by reference.

FIELD

Embodiments described herein relate generally to a developer, a method of manufacturing the same and a toner cartridge.

BACKGROUND

A toner for use in electrophotography (also known as photocopying) is configured with a binder resin, a coloring material, and a wax, or the like. However, in order to fix the toner onto the paper with low power or energy, it is desired that the glass transition point, also commonly called the glass transition temperature, of the toner is low. Generally, the lower the glass transition point is, the worse the storage preservation quality of the toner, and unification, i.e., fusing, of the toner particles or material occurs during transportation, or in the toner cartridge in transit or during residence in a copying machine main body prior to being used. In order to simultaneously support the fixability of the toner at a low glass transition point, and the storage preservation quality of that low glass transition point toner, crystalline polyester materials have recently been employed as a replacement for, or in addition to, wax in the toner.

However, there is a problem in that when crystalline polyester is used, the low temperature fixability of the toner improves, but the toner glass transition temperature Tg considerably decreases, and thus the preservative quality of the toner is considerably degenerated.

DETAILED DESCRIPTION

Figure 1:
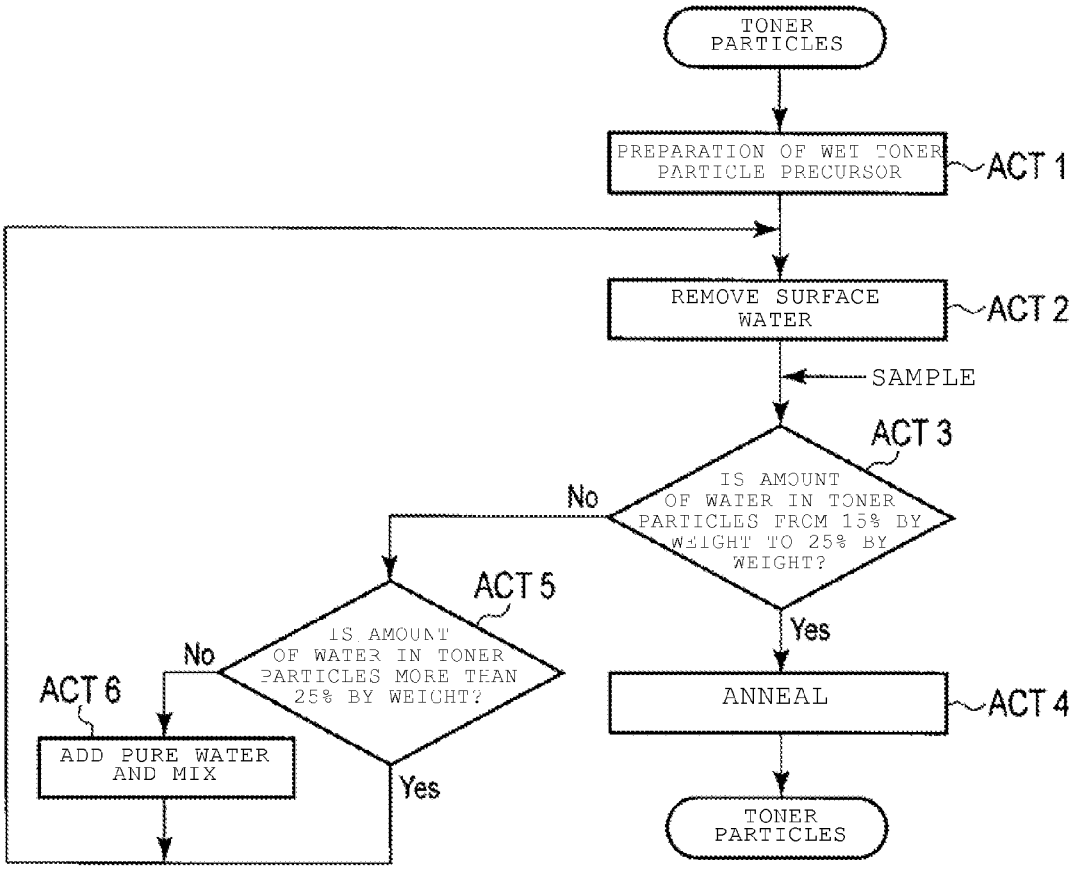
FIG. 1 is a flow chart illustrating an example of a method of manufacturing a developer according to an embodiment.

An embodiment described herein is to provide a developer capable of simultaneously enabling low temperature fixability and the preservation quality of the toner.

In general, according to one embodiment herein, a developer including toner particles which contain a crystalline polyester resin, an amorphous polyester resin and a coloring material is provided, and the bulk or core portion of the toner particles exhibits a glass transition temperature Tgc of from 30° C. to 45° C. and the surface of the toner particles exhibits a glass transition temperature Tgs of from 50° C. to 70° C. The higher Tgs at the surface enables a quantity of toner particles to experience a temperature higher than that of the core Tgc, and yet not begin fusing together, thus enhancing the shipability and thus the preservative quality of the toner.

Hereinafter, description of embodiments will be given.

A developer according to a first embodiment includes toner particles which contain a crystalline polyester resin, an amorphous polyester resin, and coloring material. In the toner particles, the core of the toner particles exhibit the glass transition temperature Tgt of from 30° C. to 45° C. and the surface of the toner particles exhibit the glass transition temperature Tgs of from 50° C. to 70° C. The composition of the core of the toner particles and the composition of the surface of the toner particles are similar.

The toner according to the first embodiment can exhibit a glass transition point of the surface of the toner particles higher than the glass transition point of the core of the toner particles. In this manner, it is possible to obtain a toner (and a developer using the toner) which can simultaneously enable low temperature fixability and preservation quality of the toner.

A method of manufacturing the developer according to a second embodiment herein is an example of a method of manufacturing the developer according to the first embodiment, and includes a step of forming a wet precursor of toner particles, the precursor having precursor toner particles which contain a crystalline polyester resin, an amorphous polyester resin, and a coloring material, and drying the precursor toner particles (wet toner).

In the method of manufacturing the toner particles, a mass or volume of wet precursor toner particles containing 20 parts by weight to 45 parts by weight of the amount of water, with respect to 100 parts by weight of the toner particles, are dried. Precursor toner particles are toner particles in which annealing of the particle to its final state has not yet occurred, but the base formulation and mixing of components is completed. The step of drying the precursor toner particles includes a step of removing the surface water from the precursor toner particles, and a step of annealing the toner particles from which the surface water was removed.

A mixture of amorphous polyester and crystalline polyester used in an embodiment can make the glass transition point of the surface of the toner particle be increased by an annealing step. According to an embodiment, by dividing the step of drying the wet toner particles into two steps including a step of removing the surface water from the wet toner particles and a step of annealing the toner particles in which the surface water was removed, the temperature of the core of the toner particle is not increased due to the heat of vaporization because water remains inside the toner particles, and it is possible to suppress an increase in the glass transition temperature Tgc of the toner particle core since annealing in the inside the toner particles is suppressed. On the other hand, on the surface of the toner particles, the temperature increases and the annealing progresses since water does not remain at that location, and thus the glass transition temperature Tgs of the toner particle surface is increased. In this way, according to an embodiment, it is possible to make the glass transition point (temperature) of the surface of the toner particles higher than the glass transition point (temperature) of the core of the toner particles, without changing the component composition of the surface and the inside of the toner particles except by adjusting the relative amount of water of the surface and the inside of the toner particles when drying the toner particles. In this manner, it is possible to obtain a toner (and a developer) which has low temperature fixability and greater preservation quality at the same time.

A toner cartridge according to a third embodiment accommodates the developer according to the first embodiment described above.

In FIG. 1, a flow chart illustrating an example of a method of manufacturing of a developer according to an embodiment is shown.

As shown in FIG. 1, in the method of manufacturing of the toner according to an embodiment, firstly, the precursor toner particles are formed using wet toner particles, i.e., particles which have the compositional components of a toner particle but which particles are not yet annealed, in which the amount of water thereof is arbitrarily adjusted (ACT 1). Secondly, the surface water on the wet precursor toner particles is removed (ACT 2). Afterward, sampling is arbitrarily performed to determine whether the amount of water in the precursor toner particles is from 15% by weight to 25% by weight (ACT 3). If the amount of water is within a range of from 15% by weight to 25% by weight, the precursor toner particles are annealed in an annealing step (ACT 4). If the amount of water is more than 25% by weight (ACT 5), the surface water is removed again. Or if the amount of water in the precursor toner particles is less than 15% by weight, for example, pure water is appropriately added to the mass or volume of precursor toner particles and mixed (ACT 6), and the surface water is again removed to reach the 15% to 25% range of water, by weight.

In the step of removing the surface water, it is possible to introduce the wet precursor toner particles into a pneumatic conveying dryer with an intake and exhaust mechanism. At this time, it is possible to adjust the exhaust temperature to 0° C. to 25° C. to dry the toner particles. By removing the surface water in this temperature range, the annealing inside the toner particles is sufficiently suppressed and it is possible to successfully suppress an increase in the glass transition temperature Tgt of the core of the resulting toner particles.

In addition, in the step of annealing the precursor toner particles from which surface water has been removed, it is possible to adjust the exhaust temperature of the pneumatic conveying dryer with an intake and exhaust mechanism to 43° C. to 50° C. to dry the precursor toner particles and thus form the toner particles. By annealing in this temperature range, while sufficiently suppressing an increase in the glass transition temperature Tgt of the core of the resulting toner particles by virtue of the water content of the core, it is possible to successfully anneal the surface of the precursor toner particles to form toner particles having the desired glass transition properties at the surface and core regions thereof.

Furthermore, in the step of removing the surface water, it is possible to dry the precursor toner particles until the amount of water of the precursor toner particles becomes 15% by weight to 25% by weight, with respect to the total weight of the toner particles. If less than 15% by weight, since the glass transition temperature Tgc of the core of the resulting toner particles increases, the low temperature fixability tends to be not satisfactory, and if more than 25% by weight, since the glass transition temperature Tgs of the surface of the resulting toner particles is not increased, the preservation quality of the resulting toner particles tends to be unsatisfactory.

In this way, according to an embodiment, by using a crystalline polyester resin and an amorphous polyester resin in the toner particle, adjusting the amount of water after the precursor toner particles are formed, and performing the step of removing the surface water and subsequently the step of annealing of the precursor toner particle surfaces, it is possible to obtain a toner having both low temperature fixability and a desirable or acceptable preservation quality.

The components of an amorphous polyester resin used in an embodiment, for example, can be manufactured by polycondensing the dicarboxylic acid component with the diol component through an esterification reaction.

As a material monomer of amorphous polyester, alcohol components having a valence of 2 or more, and carboxylic acid components such as carboxylic acid having a valence of 2 or more, a carboxylic acid anhydride, and carboxylic acid ester are used.

As a dihydric alcohol component, for example, an alkylene oxide adduct of bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, polyoxypropylene(6)-2,2-bis(4-hydroxyphenyl)propane, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, and the like may be used.

A preferred dihydric alcohol component is bisphenol A-alkylene (having 2 or 3 carbon atoms) oxide adduct (having an average addition mole number 1 to 10), ethylene glycol, propylene glycol, 1,6-hexanediol, bisphenol A, hydrogenated bisphenol A, and the like.

As an alcohol component having a valence of 3 or more, for example, sorbitol, 1,2,3,6-hexane tetrol, 1,4-sorbitan, pentaerythritol, dipentaerythritol, tripentaerythritol, 1,2,4-butane triol, 1,2,5-pentane triol, glycerol, 2-methylpropanetriol, 2-methyl-1,2,4-butane triol, trimethylol ethane, trimethylol propane, 1,3,5-trihydroxy methyl benzene, and the like may be used.

Preferred alcohol components having a valence of 3 or more are sorbitol, 1,4-sorbitan, pentaerythritol, glycerol, trimethylol propane, and the like.

In an embodiment, these dihydric alcohols and alcohols having a valence of 3 or more can be used alone or in a combination of a plurality thereof, however, particularly, it is preferable that bisphenol A-alkylene (having 2 or 3 carbon atoms) oxide adduct (having an average addition mole number of 1 to 10) be used as a main component.

As a bivalent carboxylic acid component, for example, maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, or alkenyl succinic acid such as n-dodecenyl succinic acid, alkyl succinic acid such as n-dodecyl succinic acid, or an anhydride of these acids, lower alkyl ester, and the like may be used.

A preferred bivalent carboxylic acid component is maleic acid, fumaric acid, terephthalic acid, succinic acid which is substituted with an alkenyl group having 2 to 20 carbon atoms.

As a carboxylic acid component having a valence of 3 or more, for example, 1,2,4-benzene tricarboxylic acid, 2,5,7-naphthalene tricarboxylic acid, 1,2,4-naphthalene tricarboxylic acid, 1,2,4-butanetricarboxylic acid, 1,2,5-hexanetricarboxylic acid, 1,3-dicarboxyl-2-methyl-2-methylene carboxy propane, 1,2,4-cyclohexanetricarboxylic acid, tetra (methylene carboxyl)methane, 1,2,7,8-octane tetracarboxylic acid, pyromellitic acid, empol trimer acid, or a acid anhydride thereof, lower alkyl ester, and the like may be used.

Preferred carboxylic acid components having a valence of 3 or more is 1,2,4-benzene tricarboxylic acid (trimellitic acid) and an acid anhydride thereof, alkyl (having 1 to 12 carbon atoms) ester, and the like.

In an embodiment, these bivalent carboxylic acids, or the like and carboxylic acids having a valence of 3 or more, or the like can be used alone or in a combination of a plurality thereof. Particularly, it is preferable that fumaric acid, terephthalic acid, and succinic acid which is substituted with an alkenyl group having 2 to 20 carbon atoms which are bivalent carboxylic acid components, 1,2,4-benzene tricarboxylic acid (trimellitic acid) and an acid anhydride thereof, alkyl (having 1 to 12 carbon atoms) ester thereof, and the like which are carboxylic acid components having a valence of 3 or more are used as a main component.

When a material monomer of polyester is polymerized, in order to accelerate the reaction, a catalyst which is usually used such as dibutyltin oxide, a titanium compound, dialkoxy tin(II), tin oxide(II), fatty acid tin(II) salt, dioctanoic acid tin(II) salt, distearic acid tin(II) salt can be arbitrarily used.

As wax which may be used in an embodiment, wax which is synthesized from long chain alkyl carboxylic acid and long chain alkyl alcohol components is included. The additive amount of wax is not particularly limited, however, 3 parts by weight to 10 parts by weight is preferable, with respect to 100 parts by weight of a binder resin. When less than 3 parts by weight of wax is used, the low temperature fixability tends to be not satisfactory, in addition, when more than 10 parts by weight of wax is used, the preservation quality of the resulting toner tends to be not satisfactory.

As an acid component of a crystalline polyester resin used in an embodiment, adipic acid, oxalic acid, malonic acid, maleic acid, fumaric acid, citraconic acid, itaconic acid, glutaconic acid, succinic acid, phthalic acid, isophthalic acid, terephthalic acid, sebacic acid, azelaic acid, n-dodecyl succinic acid, n-dodecenyl succinic acid, cyclohexane dicarboxylic acid, trimellitic acid, pyromellitic acid and an acid anhydride thereof, alkyl (having 1 to 3 carbon atoms) ester, and the like are included. Among these acid components, fumaric acid is preferably used. As an alcohol component, ethylene glycol, 1,2-propylene glycol, 1,3-propylene glycol, 1,4-butanediol, 1,5-pentanediol, 1,6-hexanediol, neopentyl glycol, 1,4-butenediol, polyoxypropylene, polyoxyethylene, glycerin, pentaerythritol, trimethylolpropane, and the like are included, and among these alcohol components, 1,4-butanediol and 1,6-hexanediol are preferably used.

The additive amount of a crystalline polyester resin is preferably from 3 parts by weight to 20 parts by weight, with respect to 100 parts by weight of an amorphous polyester resin. When less than 3 parts by weight, the low temperature fixability tends to be not satisfactory, in addition, when more than 20 parts by weight, the preservative quality tends to be not satisfactory.

Furthermore, in an embodiment, the crystalline polyester is referred to as crystalline polyester in which the ratio of the softening point and the melting temperature (the softening point/the melting temperature) is from 0.9 to 1.1.

Furthermore, the term softening point here is referred to as a softening point which is measured using a Flow Tester CFT-500D manufactured by Shimazu Corporation.

As a coloring material used in an embodiment, carbon black used for the applications of the color toner, an organic or an inorganic pigment or dye, and the like can be used. In an embodiment, the kinds of coloring materials are not particularly limited, however, acetylene black, furnace black, thermal black, channel black, ketjen black, or the like as carbon black, or for example, Fast Yellow G, Benzidine Yellow, India Fast Orange, Irgazin Red, Carmine FB, Permanent Bordeaux FRR, Pigment Orange R, Lithol Red 2G, Lake Red C, Rhodamine FB, Rhodamine B Lake, phthalocyanine blue, Pigment Blue, Brilliant Green B, phthalocyanine green, quinacridone, or the like as a pigment and a dye can be used alone or by mixing. In addition, the additive amount of the coloring material is not particularly limited, however, is preferably from 4 parts by weight to 15 parts by weight, with respect to 100 parts by weight of a binder resin.

As a charge control agent used in an embodiment, a metal-containing azo compound is included. As a metallic element of the metal-containing azo compound, a complex or a complex salt of iron, cobalt, and chromium, or a mixture thereof is desired. In addition, a metal-containing salicylic acid derivative compound and a metallic oxide hydrophobic treatment product are also used, as a metallic element, a complex or a complex salt of zirconium, zinc, chromium, boron, or a mixture thereof is desired. An inclusion compound of polysaccharide including aluminum and magnesium is more preferably desired. The additive amount of the charge control agent is not particularly limited, however, is preferably from 0.5 parts by weight to 3 parts by weight, with respect to 100 parts by weight of a binder resin.

As an instrument for mixing and dispersing raw materials, for example, for a mixer, mixers such as a Henschel Mixer (manufactured by Mitsui Mining Co., Ltd.); Super Mixer (manufactured by KAWATA MFG Co., Ltd.); Ribocorn (manufactured by OKAWARA MFG. CO., LTD.); Nauta Mixer, Turbulizer, Cyclomix (manufactured by Hosokawa Micron Group); Spiralpin Mixer (manufactured by Pacific Machinery & Engineering Co., Ltd.); and Lodige Mixer (manufactured by MATSUBO Corporation) are included, and as a kneader, KRC Kneader (manufactured by KURIMOTO, LTD.); Buss Ko-Kneader (manufactured by Buss); TEM type Extruder (manufactured by TOSHIBA MACHINE CO., LTD.); TEX Biaxial Kneader (manufactured by The Japan Steel Works, LTD.); PCM Kneader (manufactured by Ikegai Iron Works Co., Ltd.); Triple Roll Mill, Mixing Roll Mill, Kneader (manufactured by INOUE MFG., INC.); KNEADEX (manufactured by Mitsui Mining Co., Ltd.); MS type Pressure Kneader, Kneader Ruder (manufactured by MORIYAMA MFG. CO., LTD.); and Banbury Mixer (manufactured by KOBE STEEL, LTD.) are included.

In addition, as an instrument for roughly grinding a mixture, for example, a hammer mill, a cutter mill, a jet mill, a roller mill, a ball mill, and the like can be used. In addition, as a grinder as an instrument for finely grinding a rough ground product, a Counter jet mill, Micron jet mill and Inomizer (manufactured by Hosokawa Micron Group); IDS type mill, PJM jet grinder (manufactured by NIPPON PNEUMATIC MFG. CO., LTD.); Cross jet mill (manufactured by KURIMOTO, LTD.); ULMAX (manufactured by NISSO ENGINEERING CO., LTD.); SK JET-O-MILL (manufactured by SEISHIN ENTERPRISE Co., Ltd.); Kryptron (manufactured by Kawasaki Heavy Industries, Ltd.); and Turbo mill (manufactured by TURBO CORPORATION) are included.

In addition, in an embodiment, after the precursor toner particles are formed but prior to the drying and annealing thereof, the adjustment of the amount of water of the precursor toner particles is performed, the step of removing the surface water is performed, and then the steps of annealing and drying of the surface are performed.

The adjustment of the amount of water described above is achieved by adding 20 parts by weight or more and less than 45 parts by weight of pure water with respect to 100 parts by weight of the precursor toner particles and then performing the mixing thereof by a Henschel mixer in the case of the toner obtained by a grinding method. If the amount of water is less than 20 parts by weight, since penetration of water into the inside of the precursor toner particles becomes insufficient and annealing of the inside of the precursor toner particles cannot be suppressed in the subsequent steps of annealing and drying and the glass transition temperature Tgc of the resulting toner particle core increases, and thus the low temperature fixability tends to be not satisfactory. In addition, if the amount of water is 45 parts by weight or more, since removal of the surface water of the precursor toner particles becomes insufficient, annealing of the surface of the precursor toner particles does not progress in the subsequent steps of annealing and drying and the glass transition temperature Tgs of the surface of the resulting toner particles does not increase as compared to the core, and thus the preservation quality of the resulting toner tends to be unsatisfactory.

In addition, for forming of the wet precursor toner particles used in an embodiment, for example, the following method of manufacturing can be used.

For example, by the steps of: forming a mixture which contains at least a binder resin and a coloring material and is roughly granulated with water-based medium; finely granulating the mixture which is roughly granulated by mechanically shearing the mixture liquid; forming aggregated particles by aggregating fine particles; and as necessary, obtaining toner particles by cohering the aggregated particles; and performing solid-liquid separation of the obtained toner particles and water-based medium, the precursor toner particles are manufactured.

According to the method of manufacturing described above, after the toner particles are arbitrarily washed, it is possible to adjust the amount of water in a step of performing solid-liquid separation of the toner particles and water-based medium. If the amount of water is insufficient, after pure water is added, it is possible to mix the pure water and precursor toner particles in a Henschel mixer. In addition, if the amount of water is too great, it is possible to adjust the amount of water by drying the water-precursor toner particle mixture by an arbitrary method.

In an embodiment, afterward, the step of removing the surface water from the wet toner particles is performed. The step of removing the surface water is performed with a cyclone type collector and a pneumatic conveying dryer by adjusting the hot air temperature and the feed amount so that the exhaust temperature is 0° C. or more and less than 25° C. If the exhaust temperature is less than 0° C., since the removal of water on the surface of the toner becomes insufficient and the glass transition temperature Tgs of the surface of the toner particles does not increase, after the subsequent step of annealing, the resulting preservation quality of the toner tends to be unsatisfactory. In addition, if the exhaust temperature is more than 25° C., since water inside the toner is also removed, and annealing of the inside of the toner cannot be suppressed in the subsequent step of annealing, Tgc increases and thus the low temperature fixability of the resulting tends to be unsatisfactory.

After the step of removing the surface water, steps of annealing and drying by hot air are performed. In an embodiment, a treatment is performed with a pneumatic conveying dryer using the hot air by adjusting the hot air temperature and the feed amount so that the exhaust temperature is from 43° C. to 50° C. If the exhaust temperature is less than 43° C., annealing of the surface of the toner becomes insufficient and Tgs does not increase, and thus the preservation quality of the resulting toner tends to be not satisfactory. In addition, if the exhaust temperature is more than 50° C., annealing of the inside of the toner cannot be suppressed and Tgc increases, and thus the low temperature fixability of the resulting toner tends to be unsatisfactory.

In an embodiment, it is possible to mix a fine particle external additive to the toner particles obtained through the steps described above, in order to stabilize the liquidity, electrification characteristics and storage characteristics thereof. It is possible to use an inorganic fine particle oxide which is 1 μm or less such as silica, titania, alumina, strontium titanate, and tin oxide together. These inorganic fine particle oxides in which surface treatment is conducted by a hydrophobizing agent are used, from the viewpoint of improvement of an environmental stability. In addition, it is possible to externally add resin fine particles which are 1 μm or less other than these inorganic fine particle oxides. If the fine particle external additive is more than 1 μm, the liquidity tends to degenerate, and if less than 7 nm, since the electric charge amount significantly increases under the environment of low temperature and low humidity, developability tends to be not ensured.

As an instrument of mixing the fine particle external additive, the mixers described above are used.

As a separator used for sieving coarse particles, or the like, an Ultrasonic system (manufactured by Koei Sangyo Co., Ltd.); Rezona Sieve and Gyro Sifter (manufactured by TOKUJU Co., LTD.); Vibra sonic system (manufactured by Dalton Co., Ltd.); Soni clean (manufactured by SINTOKOGIO, LTD.); Turbo Screener (manufactured by TURBO CORPORATION); micro shifter (manufactured by MAKINO MFG CO., LTD.); a circular oscillation sieve, and the like may be employed.

The glass transition temperature Tgc of the core of the toner particles obtained is desirably from 30° C. to 45° C. If the glass transition temperature of the core is less than 30° C., since a polymer chain can move even at room temperature and compatibility with the high Tg component at the surface of the toner is required for long-term preservation, the resulting preservation quality tends to be not satisfactory. In other words, if the core can soften at too low a temperature, the effectiveness of the higher glass transition outer surface is lost or reduced, leading to fusing of the particles of toner prior to their intended use. In addition, if the glass transition temperature of the core is more than 45° C., the low temperature fixability of the resulting toner tends to be not satisfactory because it is difficult to attain the glass transition temperature in conventional photocopiers or a multi-functional peripheral (MFP) printing apparatus.

In addition, the glass transition temperature Tgs of the surface of the toner is desirably from 50° C. to 70° C. If it is less than 50° C., the preservation quality of the toner tends to be unsatisfactory, and if more than 70° C., the low temperature fixability of the toner tends to be unsatisfactory.

Figure 2:
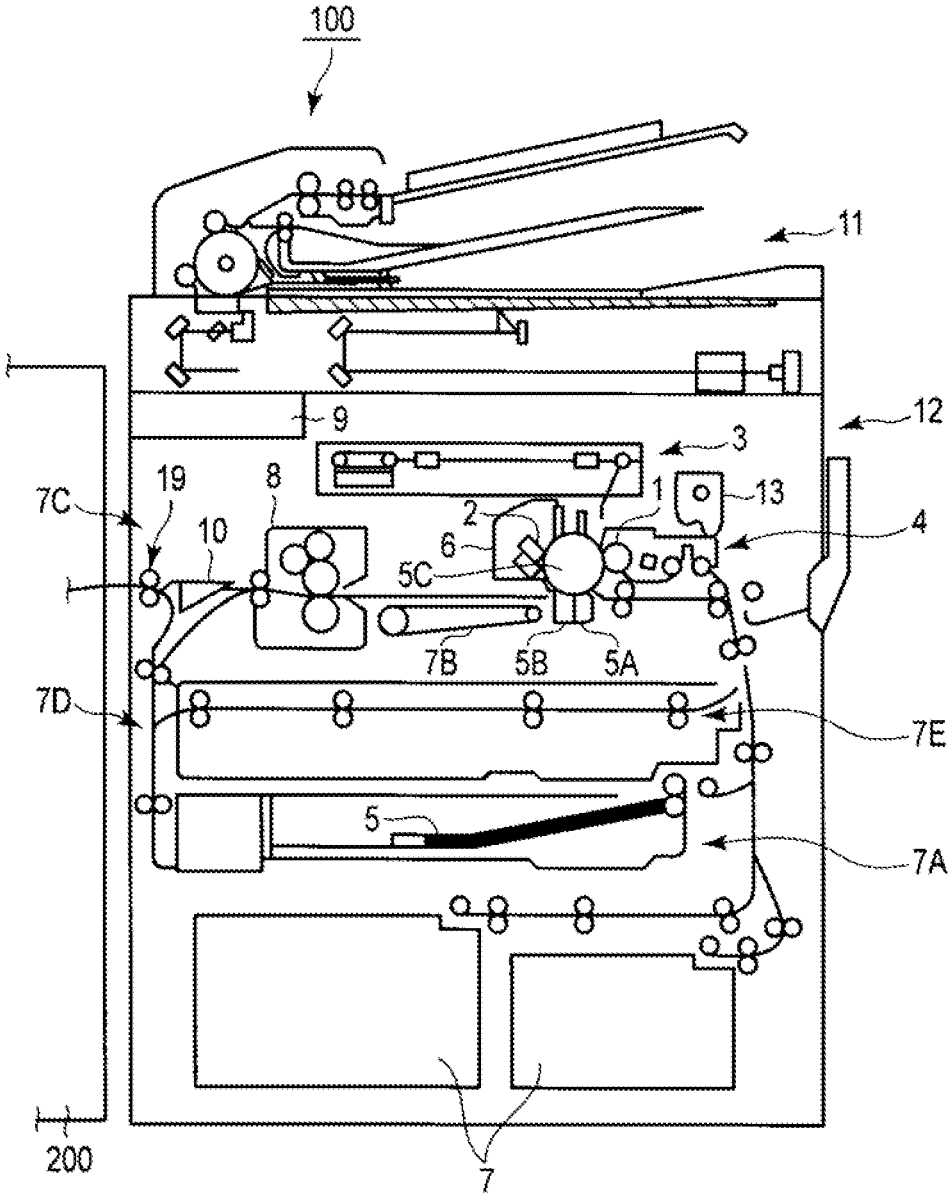
FIG. 2 is a schematic view illustrating an example of an image forming apparatus to which a developer and a toner cartridge according to an embodiment can be applied.

FIG. 2 is a schematic view illustrating an example of an image forming apparatus to which a developer and a toner cartridge according to an embodiment can be applied.

As shown in FIG. 2, an image forming unit 12 of an image forming apparatus 100 includes a photosensitive drum 1 at the central part, and an electrification unit 2, an exposure unit 3, a developing unit 4, a transfer unit 5A, a static eliminator unit 5B, a separating claw 5C and a cleaning unit 6 are respectively arranged at the circumference of the photosensitive drum 1. In addition, a fixing unit 8 is provided on the downstream side of the static eliminator unit 5B. An image forming treatment is performed by each unit by the procedure substantially in the following order.

The electrification unit 2 uniformly charges the surface of the photosensitive drum 1. On the other hand, an image on a document which is read in a reading unit 11 is converted into an image data to be input into the exposure unit 3. The photosensitive drum 1 is irradiated with a laser beam according to the level of the image data in the exposure unit 3 to form an electrostatic latent image on the photosensitive drum 1. The electrostatic latent image is developed by the toner which is supplied from the developing unit 4 to form a toner image on the photosensitive drum 1. Furthermore, a toner cartridge 13 is detachably accommodated in the apparatus 100 above the developing unit 4. The toner cartridge 13 supplies the toner to the developing unit 4 by a toner supply mechanism (not shown).

A paper stored in a paper storing unit 7 is fed to a transfer position (a gap between the photosensitive drum 1 and a transfer unit 5A) through several feeding rollers. At the transfer position, the toner image is transferred on a paper in the transfer unit 5A. After transferring, an electric charge on the surface of the paper is erased by the static eliminator unit 5B. The paper is separated from the photosensitive drum 1 by the separating claw 5C to be fed by an intermediate feeding unit 7B. The toner image is fixed onto the paper by heating and applying pressure in the fixing unit 8 and a fixing treatment is finished. The paper is discharged from a discharging unit 7C and is output to a paper post-processing apparatus 200.

Downstream of the separating claw 5C, by using the cleaning unit 6, the developer which remains on the surface of the photosensitive drum 1 is removed to prepare for a next image formation.

When two-sided printing is performed, the front and the back of the paper in which the toner image is fixed on the surface are reversed. Reversing the paper is performed by branching from a usual discharge passage by a feeding path switching plate 7D and by switching back in a reversing feeding unit 7E. After reversing the paper, a printing treatment is performed in the same way as single-sided printing, with respect to the back side. The paper is fed to the paper post-processing apparatus 200 through a discharging roller 19 provided in the discharging unit 7C. The discharging roller 19 includes an upper roller 19*a* and a lower roller 19*b*.

The paper post-processing apparatus 200 performs a post-processing of the paper which is discharged from the image forming apparatus 100. The post-processing includes, for example, sorting and stapling, furthermore, discharging by folding in two after the paper is saddle-stitched as necessary, or the like.

EXAMPLE

Preparation of Crystalline Polyester 1,300 parts of 1,6-hexanediol, 1,300 parts of fumaric acid, 1 part of hydroquinone, and 10 parts of 2-ethylhexanoic acid tin (II) salt were put into a four-necked flask with a volume of 5 L provided with a nitrogen introducing pipe, a dewatering conduit, a stirrer, and a thermocouple and was reacted at 160° C. for 5 hours, and subsequently, was heated to 200° C. and reacted for 3 hours, and furthermore, reacted for 1 hour at 8.3 kPa.

In addition, to determine a melting point of the obtained crystalline polyester, a differential scanning calorimetry (DSC) apparatus "DSC Q2000 (manufactured by TA Instruments Japan)" is used. The measurement was performed under the conditions of sample: 5 mg, lid and pan: alumina, temperature rise rate: 10° C./minute, measured temperatures: 20° C. to 200° C., the sample heated up to 200° C. was cooled to 20° C. or less and was heated again to be measured and that measurement used as the melting point, and a maximum exothermic peak which occurs at around 80° C. to around 120° C. was taken as a melting point crystal The melting point of the crystalline polyester resin (a) was measured to be 102° C.

Formation of Medium Grinding Ground Particles 1:

82 parts by weight of an amorphous polyester resin (Tg=55° C.), 8 parts by weight of the crystalline polyester resin, 5 parts by weight of a cyan pigment (copper phthalocyanine) as a coloring material, 4 parts by weight of an ester wax, and 1 part by weight of a zirconium metallic complex as an electrostatic charge controlling agent were mixed, and subsequently were melted and kneaded by a biaxial kneader in which the temperature was set to 120° C. to obtain a kneaded product.

The obtained kneaded product was roughly ground by a hammer mill manufactured by NARA MACHINERY CO., LTD to a volume average particle diameter of 1.2 mm, furthermore, the rough particles were put into a Bantam Mill manufactured by Hosokawa Micron Group in which the number of revolutions thereof was set to 12,000 rpm, to obtain the medium ground particles of the medium grinding.

Formation of Medium Grinding Particles 2:

82 parts by weight of an amorphous polyester resin (Tg=50° C.), 8 parts by weight of the crystalline polyester resin described above, 5 parts by weight of a cyan pigment (copper phthalocyanine) as a coloring material, 4 parts by weight of an ester wax, and 1 part by weight of a zirconium metallic complex as an electrostatic charge controlling agent were mixed, and subsequently were melted and kneaded by a biaxial kneader in which the temperature was set to 120° C. to obtain a kneaded product.

The obtained kneaded product was roughly ground by a hammer mill manufactured by NARA MACHINERY CO., LTD to a volume average particle diameter of 1.2 mm, furthermore, the rough particles were put into a Bantam Mill manufactured by Hosokawa Micron Group in which the number of revolutions thereof was set to 12,000 rpm to obtain the medium ground particles of the medium grinding step.

Formation of Medium Grinding Particles 3:

82 parts by weight of an amorphous polyester resin (Tg=74° C.), 8 parts by weight of the crystalline polyester resin described above, 5 parts by weight of a cyan pigment (copper phthalocyanine) as a coloring material, 4 parts by weight of an ester wax, and 1 part by weight of a zirconium metallic complex as an electrostatic charge controlling agent were mixed, and subsequently were melted and kneaded by a biaxial kneader in which the temperature was set to 120° C. to obtain a kneaded product.

The obtained kneaded product was roughly ground by a hammer mill manufactured by NARA MACHINERY CO., LTD to the volume average particle diameter of 1.2 mm, furthermore, the rough particles were put into a Bantam Mill manufactured by Hosokawa Micron Group in which the number of revolutions thereof was set to 12,000 rpm to obtain the medium ground particles of the medium grinding step.

Formation of Medium Grinding Particles 4:

82 parts by weight of an amorphous polyester resin (Tg=43° C.), 8 parts by weight of the crystalline polyester resin described above, 5 parts by weight of a cyan pigment (copper phthalocyanine) as a coloring material, 4 parts by weight of an ester wax, and 1 part by weight of a zirconium metallic complex as an electrostatic charge controlling agent were mixed, and subsequently were melted and kneaded by a biaxial kneader in which the temperature was set to 120° C. to obtain a kneaded product.

The obtained kneaded product was roughly ground by a hammer mill manufactured by NARA MACHINERY CO., LTD to the volume average particle diameter of 1.2 mm, furthermore, the rough particles were put into a Bantam Mill manufactured by Hosokawa Micron Group in which the number of revolutions thereof was set to 12,000 rpm to obtain the medium ground particles of the medium grinding step.

Formation of Medium Grinding Particles 5:

82 parts by weight of an amorphous polyester resin (Tg=81° C.), 8 parts by weight of the crystalline polyester resin described above, 5 parts by weight of a cyan pigment (copper phthalocyanine) as a coloring material, 4 parts by weight of an ester wax, and 1 part by weight of a zirconium metallic complex as an electrostatic charge controlling agent were mixed, and subsequently were melted and kneaded by a biaxial kneader in which the temperature was set to 120° C. to obtain a kneaded product.

The obtained kneaded product was roughly ground by a hammer mill manufactured by NARA MACHINERY CO., LTD to the volume average particle diameter of 1.2 mm, furthermore, the rough particles were put into a Bantam Mill manufactured by Hosokawa Micron Group in which the number of revolutions thereof was set to 12,000 rpm to obtain the medium ground particles of the medium grinding step.

Example 1

40 parts by weight of the medium ground particles 1, 2 parts by weight of sodium dodecylbenzenesulfonate and 2 parts by weight of a sodium salt of a copolymer of acrylic acid and maleic acid as a dispersing agent, 2 parts by weight of triethylamine as an auxiliary agent for dispersing, and 65 parts by weight of ion-exchange water were preliminary dispersed in an ULTRA-TURRAX T50 manufactured by IKA Works Inc. to obtain a preliminary dispersion liquid.

The preliminary dispersion liquid described above was put into Nano-Mizer (manufactured by Yoshida Kikai Co., Ltd., with an added heating system to YSNM-2000AR). The temperature of a heating system was set to 160° C. to repeatedly perform a treatment three times at a treatment pressure of the Nano-Mizer of 160 MPa. In a state in which the dispersion liquid described above was maintained at 40° C., 2 parts by weight of aluminum sulphate were added, the temperature was heated up to 55° C., and the colored fine particles were agglutinated so that they had the desired volume average particle diameter and an agglutinated particle dispersion liquid was obtained. Afterward, after 4 parts by weight of a sodium salt of a copolymer of acrylic acid and maleic acid as a dispersion stabilizer were added, the temperature was increased to 90° C. and maintained at 90° C. for 3 hours to obtain a cohesive particle dispersion liquid.

After the solid-liquid separation was performed for this cohesive particle dispersion liquid, 600 ml of ion-exchange water as rinse water was supplied to wash the solid. After solid-liquid separation was performed by filtering under reduced pressure, a wet cake including the wet toner particles was obtained by adjusting filtration time under reduced pressure so that the amount of remaining water in the wet cake is 20% by weight. After the obtained wet cake was treated using a flash jet dryer, by adjusting the exhaust temperature to 5° C. to remove the surface water, and then adjusting the exhaust temperature to 43° C. to anneal and dry the toner particles, toner particles in which the average volume particle diameter was 4.8 μm were obtained.

After 2% by mass of Si external additive (R974: manufactured by Nippon Aerosil Co., Ltd.) was added to the obtained toner particles and external addition treatment by a Henschel mixer was conducted, a toner of Example 1 was obtained by sieving using ultrasonic vibration.

The glass transition temperature Tgc of the core of the toner was measured using a differential scanning calorimetry (DSC) apparatus "DSC Q2000 (manufactured by TA Instruments Japan)". 5 mg of a sample was used, alumina was used as a lid and a pan, an equilibrium temperature was 0° C., a measured temperature was heated up from 20° C. to 200° C. at 10° C./min of a temperature raising rate, and the measurement was performed. The obtained Tgc was 41° C. Afterward, for the measurement of the glass transition temperature Tgs of the toner surface, a thermal cantilever (AN2-200) in Nano-TA system "E-sweep/Nano Navi II station/Nano-TA2 system: manufactured by SII Nano Technology" which is a local thermal analysis system was used to measure. The temperature of the peak top of the deflection was measured at ten different points with heating up at 20° C./min, and the minimum value was taken as the glass transition temperature Tgs of the toner surface. When the toner in Example 1 was measured, Tgs was 53° C.

Evaluation of Low Temperature Fixability:

By remodelling a fixing system of e-studio 2050c (manufactured by TOSHIBA TEC CORPORATION), a fixing temperature is set to 130° C. and 10 sheets of a solid image are acquired. The case of no peeling of an image due to offset and unfixing on the 10 sheets occurs was set to G, and a case of occurring was set to B.

Evaluation of Preservative Quality:

20 g of the toner was sealed in a plastic container and left for 10 hours in a constant temperature reservoir which was set to 50° C. After removing the plastic container from the constant temperature reservoir, the toner was naturally cooled for 12 hours or more and the toner was put on a sieve of an opening of 42 mesh to oscillate for 10 seconds at scale 4 using a powder tester (manufactured by Hosokawa Micron Group). A case of the remaining quantity of the toner on a sieve of from 0 g to less than 3 g was set to G and a case of 3 g or more was set to B.

Evaluation results are shown in Table 1 described below.

Example 2

The medium ground particles 1 were ground using a jet mill, and then, after the toner particles were obtained by classifying the ground particles using a rotor type classifier, 40 parts by weight of pure water were added with respect to 100 parts by weight of the toner particles and mixing was performed by Henschel mixer. Afterward, the obtained toner particles were treated by a flash jet dryer with the exhaust temperature adjusted to 25° C. to remove the surface water, and then the exhaust temperature was adjusted to 50° C. in the flash jet dryer to dry the particles, thereby obtaining toner particles in which the average volume particle diameter was 5.2 μm. The measurements of Tgc and Tgs were performed in the same way as Example 1, and Tgc was 43° C. and Tgs was 55° C.

In the same way as Example 1, the low temperature fixability and the preservative quality were measured. The results thereof are shown in Table 1 described below.

Example 3

The same operation as Example 2 was performed except using the medium ground particles 2, and the toner particles having the average volume particle diameter of 5.2 μm were obtained. The measurements of Tgc and Tgs were performed in the same way as Example 1, and Tgc was 32° C. and Tgs was 51° C.

In the same way as Example 1, the low temperature fixability and the preservative quality were measured. The results thereof are shown in Table 1 described below.

Example 4

The same operation as Example 2 was performed except using the medium ground particles 3, and the toner particles having the average volume particle diameter of 4.7 μm were obtained. The measurements of Tgc and Tgs were performed in the same way as Example 1, and Tgc was 44° C. and Tgs was 67° C.

In the same way as Example 1, the low temperature fixability and the preservative quality were measured. The results thereof are shown in Table 1 described below.

Comparative Example 1

After the solid-liquid separation was performed by filtering under reduced pressure, the same operation as Example 1 was performed except adjusting filtration time under reduced pressure so that the amount of water was 50% to obtain a wet cake, and the toner particles having the average volume particle diameter of 5.0 μm were obtained. The measurements of Tgc and Tgs were performed in the same way as Example 1, and Tgt was 40° C. and Tgs was 46° C.

In the same way as Example 1, the low temperature fixability and the preservative quality were measured. The results thereof are shown in Table 1 described below.

Comparative Example 2

After the solid-liquid separation was performed by filtering under reduced pressure, the same operation as Example 1 was performed except adjusting filtration time under reduced pressure so that the amount of water is 17% to obtain a wet cake, and the toner particles having the average volume particle diameter of 5.0 μm were obtained.

The measurements of Tgc and Tgs were performed in the same way as Example 1, and Tgc was 48° C. and Tgs was 53° C.

Comparative Example 3

The same operation as Example 2 was performed except using the medium ground particles 4, and toner particles having the average volume particle diameter of 5.5 μm were obtained. The measurements of Tgc and Tgs were performed in the same way as Example 1, and Tgc was 28° C. and Tgs was 53° C.

In the same way as Example 1, the low temperature fixability and the preservative quality were measured. The results thereof are shown in Table 1 described below.

Comparative Example 4

The same operation as Example 1 was performed except using the medium ground particles 5, and toner particles having an average volume particle diameter of 5.0 μm were obtained. The measurements of Tgc and Tgs were performed in the same way as Example 1, and Tgc was 52° C. and Tgs was 72° C.

In the same way as Example 1, the low temperature fixability and the preservative quality were measured. The results thereof are shown in Table 1 described below.

Comparative Example 5

The same operation as Example 1 was performed except conducting the treatment by a flash jet dryer in the step of removing the surface water with the exhaust temperature adjusted to 28° C., and toner particles having the average volume particle diameter of 4.8 μm were obtained. The measurements of Tgc and Tgs were performed in the same way as Example 1, and Tgc was 47° C. and Tgs was 54° C.

In the same way as Example 1, the low temperature fixability and the preservative quality were measured. The results thereof are shown in Table 1 described below.

Comparative Example 6

The same operation as Example 1 was performed except using the medium ground particles 2 and conducting the treatment by a flash jet dryer in the steps of annealing and drying with the exhaust temperature adjusted to 41° C., and toner particles having an average volume particle diameter of 5.3 μm were obtained. The measurements of Tgc and Tgs were performed in the same way as Example 1, and Tgc was 31° C. and Tgs was 43° C.

In the same way as Example 1, the low temperature fixability and the preservative quality were measured. The results thereof are shown in Table 1 described below.

Comparative Example 7

The same operation as Example 4 was performed except conducting the treatment by a flash jet dryer in the steps of annealing and drying with the exhaust temperature adjusted to 52° C., and toner particles having an average volume particle diameter of 5.4 μm were obtained. The measurements of Tgc and Tgs were performed in the same way as Example 1, and Tgc was 45° C. and Tgs was 72° C.

In the same way as Example 1, the low temperature fixability and the preservative quality were measured. The results thereof are shown in Table 1 described below.

TABLE 1

| | | Step of removing surface water | | Step of annealing | | | | |
|---|---|---|---|---|---|---|---|---|
| | Medium ground particles Type | Amount of water before treatment (part by weight) | Exhaust temperature (° C.) | Exhaust temperature (° C.) | Tgc (° C.) | Tgs (° C.) | Low temperature fixability | Preservative quality |
| Example 1 | 1 | 20 | 5 | 43 | 41 | 53 | G | G |
| Example 2 | 1 | 40 | 25 | 50 | 43 | 55 | G | G |
| Example 3 | 2 | 20 | 5 | 43 | 32 | 51 | G | G |
| Example 4 | 3 | 20 | 5 | 43 | 44 | 67 | G | G |
| Comparative Example 1 | 1 | 50 | 5 | 43 | 40 | 46 | G | B |

TABLE 1-continued

| | Medium ground particles Type | Step of removing surface water: Amount of water before treatment (part by weight) | Step of removing surface water: Exhaust temperature (° C.) | Step of removing surface water: Exhaust temperature (° C.) | Step of annealing: Tgc (° C.) | Step of annealing: Tgs (° C.) | Low temperature fixability | Preservative quality |
|---|---|---|---|---|---|---|---|---|
| Comparative Example 2 | 1 | 17 | 5 | 43 | 48 | 53 | B | G |
| Comparative Example 3 | 4 | 40 | 25 | 50 | 28 | 53 | G | B |
| Comparative Example 4 | 5 | 20 | 5 | 43 | 52 | 72 | B | B |
| Comparative Example 5 | 1 | 20 | 28 | 43 | 47 | 54 | B | G |
| Comparative Example 6 | 2 | 20 | 5 | 41 | 31 | 43 | G | B |
| Comparative Example 7 | 3 | 20 | 25 | 52 | 45 | 72 | B | G |

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A toner comprising:

toner particles, each having a core and a surface that have common components therein, wherein the cores of the toner particles each have a glass transition temperature of from 30° C. to 45° C., and the surfaces of the toner particles each have a glass transition temperature of from 50° C. to 70° C., the common components include at least a crystalline polyester resin, an amorphous polyester resin, and a coloring material, and the quantity of the crystalline polyester resin in the common components is less than the quantity of the amorphous polyester resin in the common components, by weight.

2. The toner of claim 1, wherein the quantity of the crystalline polyester resin in the common components is 3 parts by weight to 20 parts by weight, with respect to 100 parts by weight of the amorphous polyester resin in the common components.

3. The toner of claim 1, wherein the quantity of the crystalline polyester resin in the cores and the surfaces are the same.

4. The toner of claim 1, wherein the quantity of the amorphous polyester resin in the cores and the surfaces are the same.

5. The toner of claim 1, wherein the common components include wax.

6. A toner cartridge comprising:

a container; and toner particles, each having a core and a surface that have common components therein, wherein the cores of the toner particles each have a glass transition temperature of from 30° C. to 45° C., and the surfaces of the toner particles each have a glass transition temperature of from 50° C. to 70° C., the common components include at least a crystalline polyester resin, an amorphous polyester resin, and a coloring material, and the quantity of the crystalline polyester resin in the common components is less than the quantity of the amorphous polyester resin in the common components by weight.

7. The toner cartridge of claim 6, wherein the quantity of the crystalline polyester resin in the common components is 3 parts by weight to 20 parts by weight, with respect to 100 parts by weight of the amorphous polyester resin in the common components.

8. The toner cartridge of claim 6, wherein the quantity of the crystalline polyester resin in the cores and the surfaces are the same.

9. The toner of claim 1, wherein a ratio of the quantity of the crystalline polyester resin with respect to the quantity of the amorphous polyester resin in the cores is the same as a ratio of the quantity of the crystalline polyester resin with respect to the quantity of the amorphous polyester resin in the surfaces.

10. The toner of claim 9, wherein a ratio of the quantity of the crystalline polyester resin with respect to the coloring material in the cores is the same as a ratio of the quantity of the crystalline polyester resin with respect to the quantity of the coloring material in the surfaces.

11. The cartridge according to claim 6, wherein the quantity of the amorphous polyester resin in the cores and the surfaces are the same.

12. The cartridge according to claim 6, wherein the common components include wax.

13. The cartridge according to claim 6, wherein a ratio of the quantity of the crystalline polyester resin with respect to the quantity of the amorphous polyester resin in the cores is the same as a ratio of the quantity of the crystalline polyester resin with respect to the quantity of the amorphous polyester resin in the surfaces.

14. The cartridge according to claim 13, wherein a ratio of the quantity of the crystalline polyester resin with respect to the coloring material in the cores is the same as a ratio of the quantity of the crystalline polyester resin with respect to the quantity of the coloring material in the surfaces.

* * * * *